US011377954B2

(12) United States Patent
Reyenga et al.

(10) Patent No.: US 11,377,954 B2
(45) Date of Patent: Jul. 5, 2022

(54) COMPRESSOR OR TURBINE WITH BACK-DISK SEAL AND VENT

(71) Applicant: HONEYWELL INTERNATIONAL INC., Morristown, NJ (US)

(72) Inventors: James W. Reyenga, Long Beach, CA (US); Glenn F. Thompson, Palos Verdes Estates, CA (US); Mike Guidry, Redondo Beach, CA (US)

(73) Assignee: Garrett Transportation I Inc., Torrance, CA (US)

( * ) Notice: Subject to any disclaimer, the term of this patent is extended or adjusted under 35 U.S.C. 154(b) by 687 days.

(21) Appl. No.: 14/108,225

(22) Filed: Dec. 16, 2013

(65) Prior Publication Data

US 2015/0167467 A1 Jun. 18, 2015

(51) Int. Cl.

| | |
|---|---|
| ***F01D 3/00*** | (2006.01) |
| ***F04D 29/051*** | (2006.01) |
| ***F01D 11/02*** | (2006.01) |
| ***F04D 29/28*** | (2006.01) |
| ***F01D 3/04*** | (2006.01) |
| ***F04D 17/10*** | (2006.01) |
| ***F04D 29/041*** | (2006.01) |
| ***F04D 29/22*** | (2006.01) |

(52) U.S. Cl.

CPC ..... *F01D 3/00* (2013.01); *F01D 3/04* (2013.01); *F01D 11/02* (2013.01); *F04D 17/10* (2013.01); *F04D 29/0413* (2013.01); *F04D 29/0516* (2013.01); *F04D 29/2266* (2013.01); *F04D 29/284* (2013.01)

(58) Field of Classification Search

CPC . F01D 3/00–04; F04D 29/051; F04D 29/2266

USPC ..... 415/104

See application file for complete search history.

(56) References Cited

U.S. PATENT DOCUMENTS

| | | | | |
|---|---|---|---|---|
| 2,744,722 A | | 5/1956 | Orr | |
| 2,779,531 A | | 1/1957 | Wheatley | |
| 2,925,290 A | * | 2/1960 | Greenwald | F01D 11/025 277/388 |
| 3,179,328 A | | 4/1965 | Pouit | |
| 3,535,873 A | | 10/1970 | Szydlowski | |

(Continued)

FOREIGN PATENT DOCUMENTS

| | | | |
|---|---|---|---|
| DE | 1628233 | * | 11/1971 |
| EP | 0 518 027 A1 | | 12/1992 |

(Continued)

OTHER PUBLICATIONS

Translation of DE1628233 (Year: 1971).*

(Continued)

*Primary Examiner* — J. Todd Newton, Esq.
*Assistant Examiner* — Brian O Peters
(74) *Attorney, Agent, or Firm* — The Law Office of John A. Griecci

(57) ABSTRACT

A turbine or compressor wheel mounted in a housing. The wheel is carried on two radial bearings both mounted in a wall of the housing. The wall has a venting orifice that is not impeded by moving parts such as bearings. The wall also has a circular seal member extending toward a back-disk of the wheel with only a very small clearance. The seal member is composed of a material significantly softer than the material of the wheel.

20 Claims, 1 Drawing Sheet

(56) References Cited

U.S. PATENT DOCUMENTS 3,748,056 A 7/1973 Nakanishi et al.
4,170,435 A * 10/1979 Swearingen ..... F04D 29/0416 415/1
4,472,107 A * 9/1984 Chang ..... F01D 3/04 415/104
4,721,313 A 1/1988 Pennink
4,946,346 A 8/1990 Ito
5,141,389 A 8/1992 Bear et al.
5,199,848 A 4/1993 Kapich
5,297,928 A * 3/1994 Imakiire ..... F04D 29/5846 415/112
5,358,378 A 10/1994 Holscher
6,190,123 B1 2/2001 Wunderwald et al.
6,224,327 B1 5/2001 Aoki et al.
6,238,179 B1 * 5/2001 Wunderwald ..... F04D 29/5846 415/110
6,286,303 B1 9/2001 Pfligler et al.
6,860,110 B2 3/2005 Akiyama et al.
7,011,492 B2 3/2006 Schwartz et al.
7,252,474 B2 * 8/2007 Belokon ..... F01D 3/04 415/1
7,527,470 B2 5/2009 Guimbard et al.
7,740,441 B1 6/2010 Huber et al.
7,891,945 B2 2/2011 Tisenchek et al.
8,047,786 B2 11/2011 Tisenchek et al.
8,701,477 B2 * 4/2014 Malone ..... F02D 41/221 73/114.77
9,133,725 B2 * 9/2015 Wiebe ..... F01D 11/02
2005/0058533 A1 3/2005 Belokon et al.
2007/0063449 A1 * 3/2007 Muller ..... F04D 29/051 277/411
2007/0119184 A1 5/2007 Satou et al.
2008/0095610 A1 * 4/2008 Bosen ..... F01D 25/168 415/104
2009/0243222 A1 10/2009 Pisseloup
2010/0111672 A1 5/2010 Hesting
2011/0311352 A1 12/2011 Bruhwiler et al.

FOREIGN PATENT DOCUMENTS

EP 0 984 137 A2 3/2000
WO WO 2011/078680 A1 6/2011

OTHER PUBLICATIONS

EPO "Communication" including an extended European Search Report, in counterpart EPO Application No. EP 14193937.1, dated Apr. 23, 2015.

* cited by examiner

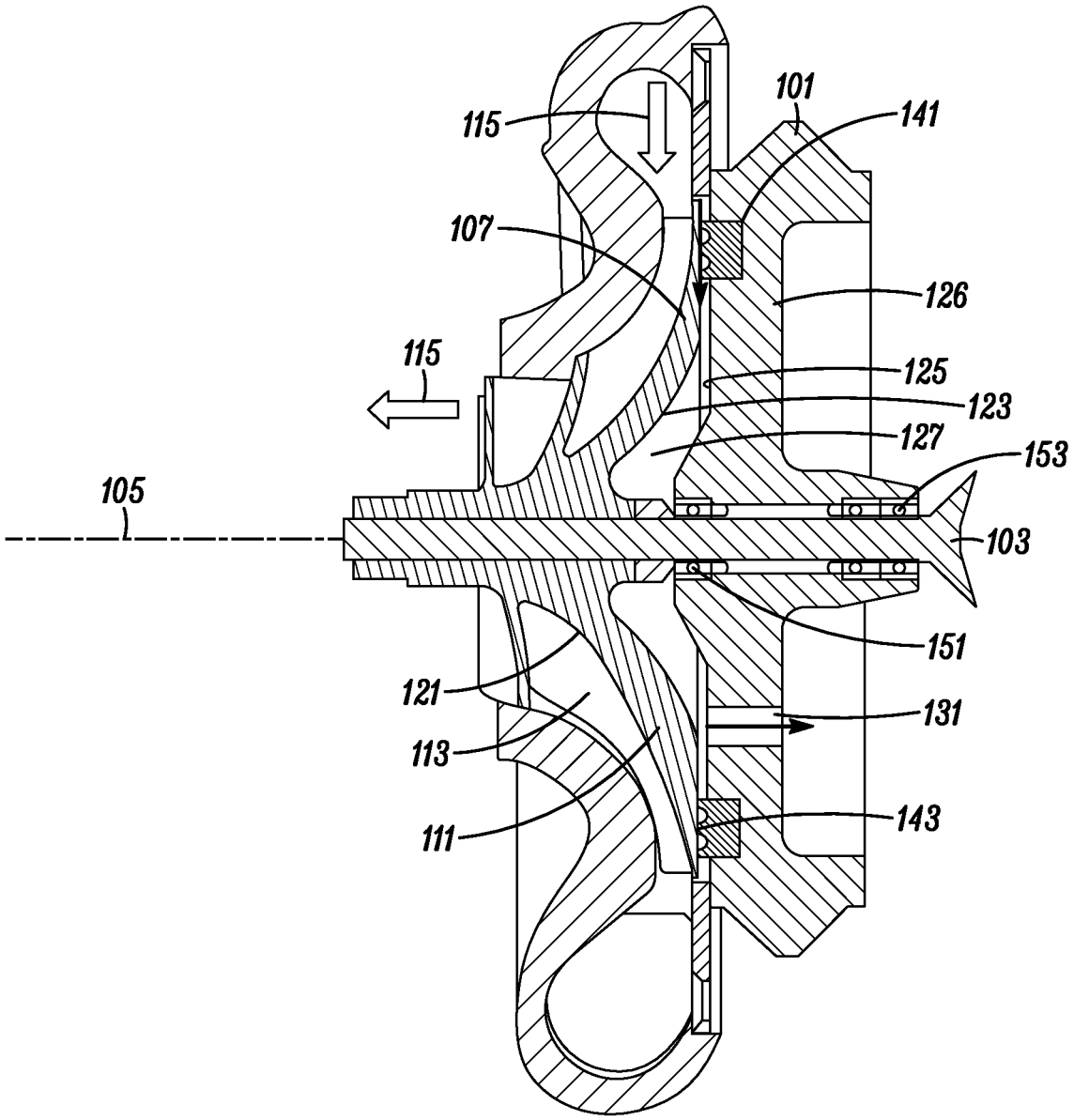
101
141
115
107
126
115
125
123
127
153
105
103
151
121
131
113
143
111

COMPRESSOR OR TURBINE WITH BACK-DISK SEAL AND VENT

The present invention relates generally to compressors and turbines, and, more particularly, to a radial turbine and/or compressor wheel having a bearing housing soft seal and a calibrated vent in a bearing mount.

BACKGROUND OF THE INVENTION

A wide array of mechanical and electro-mechanical machines are rotary machines. These rotary machines typically include a rotary-device-housing formed by one or more sub-housings, and a rotor having a plurality of wheels, electrical windings, magnets, and other such rotor-devices that may be arrayed along the rotor. Typically, such rotors are supported within the housing by a set of bearings that include a plurality of radial-support bearings in a plurality of axial locations along the rotor, and one or more axial-support bearings in at least one axial location.

Typically, the rotors are designed and balanced to minimize off-axis movement, and thus minimize the size and rotational energy loss of the radial-support bearings. Nevertheless, the wide array of wheels and other rotor-devices that may be arrayed along a rotor can provide a wide array of axial forces. The sum of the axial loads developed by the rotor-devices must be absorbed by the axial-support bearings. Thus, it is not uncommon for such rotors to have axial-support bearings that produce rotational drag that impacts performance, weight, cost, and functional lifetime (e.g., due to wear).

Rotational pressure-changing wheels (e.g., compressor wheels and turbine wheels) are used as rotor-devices in a wide array of rotary machines. For example, a compressor's wheel may be connected on a rotor to one or more rotor-devices that form a source of rotational kinetic energy, such as the windings of an electric motor, when the pressurization of a gas is desired. Likewise, a turbine's wheel may be connected on a rotor as a rotor-device to form a source of kinetic energy to drive a variety of other rotor-devices, such as the windings of an electric generator. A compressor and a turbine may be combined in a turbocharger, which is typically configured with rotor-devices including a turbine wheel and a compressor wheel on a rotor so as to provide pressurized air to an engine, and then to use pressurized and heated exhaust air to drive the turbine wheel in turning the compressor wheel.

Some rotary machines are configured to operate in mostly constant operational conditions that only vary in startup and stopping conditions. These devices may be designed with axial-load features that minimize axial rotor force by having offsetting axial forces from the rotor-devices in the constant operational conditions.

Other rotary machines are configured to operate in a variety of operational conditions. For these devices, it may be desirable to minimize the axial force produced by each rotor-device in any operational condition, to minimize the highest total axial force for all rotor-devices in any operational condition, and/or to minimize the net harmful effects of the forces over the lifetime of the rotary machine. These devices are preferably designed with axial-load features that are tuned to the optimal combination of rotor-device axial rotor forces, i.e., by having offsetting forces from the differing rotor-devices that maximize the performance, weight, cost, and functional lifetime based on the requirements of the rotary machine. In either case (constant operational conditions or variety of operational conditions), it is desirable to have rotor-device designs that may be tuned to the specific axial-load needs of the rotary machine.

Radial flow wheels and mixed flow wheels (i.e., partially radial and partially axial flow wheels) are commonly used rotor-devices in rotary machines that form compressors and turbines. These wheels typically include a hub and a plurality of blades arrayed around the hub. The hub includes a blade surface that carries and supports the blades, and a back surface that will be called a "back-disk" for the purposes of this patent application. Typically, the back-disk faces a wall of a bearing housing, which is a sub-housing of the rotary-device-housing.

During the operation of the wheel, gas (e.g., air or exhaust gas) passes through the blades from an inducer to an exducer, causing pressurization changes to the gas. Some of this gas may seep from the intended gas pathway between the blades to a back-disk chamber behind the hub, between the back-disk and a wall behind the back-disk (such as the wall of a bearing housing). This gas may cause undesirable axial loads on the rotor.

It is known to form a circumferentially extending protrusion (a circular speed bump) on the back-disk to minimize the flow of gas into the back-disk chamber. Because contact between the speed bump and the wall behind the back-disk would cause significant degradation of operation and mechanical reliability, such speed bumps must have a significant clearance with the wall behind the back disk. This large clearance limits the effectiveness of the speed bump.

It is also known to vent gas from the back-disk chamber through bearings in a bearing housing forming the wall behind the back-disk. The flow rate of this vent is not controlled, and may change over time as the bearings wear.

Accordingly, there exists a need for rotary machine configurations that include rotor-devices having axial loads that can be fine tuned by controlling the pressure of the gas in a back-disk chamber. Preferred embodiments of the present invention satisfy these and other needs, and provide further related advantages.

SUMMARY OF THE INVENTION

In various embodiments, the present invention solves some or all of the needs mentioned above, typically providing a cost effective rotary machine characterized by minimized or tuned axial loads due to pressure behind the back-disk of a rotor wheel.

The rotary machine includes a housing and a rotor. The rotor is configured to rotate within the housing along an axis of rotor rotation. The rotor includes a rotational pressure-changing wheel such as a compressor wheel or a turbine wheel. This wheel is configured with a hub and with a plurality of blades. The blades are configured to exchange the pressure of gas passing through the blades and rotor kinetic rotational energy. For a compressor wheel the blades are configured to compress air, and for a turbine wheel the blades are configured to be driven in rotation by pressurized gas.

The hub includes a blade surface that carries and supports the blades, and a back-disk on an axially opposite side of the hub from the blade surface. The housing forms a chamber wall facing the back-disk. The chamber wall and back-disk define a back-disk chamber.

Advantageously, the chamber wall forms an orifice that opens the back-disk chamber to an environment having a different pressure from the back-disk chamber. The orifice is not impeded by moving parts such as bearings. The orifice vents the back-disk chamber, limiting axial loads imparted on the back-disk by pressurized gas. The effective size of the orifice may be selected to limit the pressure change of the back-disk chamber through the orifice.

The rotary machine may further feature a back-disk seal member extending substantially between the back-disk and the chamber wall with only a very small clearance. The back-disk seal member extends circumferentially around the back-disk chamber, and is composed of a material significantly softer than the materials of the hub and the chamber wall. Advantageously, the softness of the seal member provides for it to inconsequentially wear away if the clearance is too small and it comes into contact with another surface. This allows the clearance to be designed smaller than it otherwise could.

The rotary machine may further feature that the back-disk seal member extends from the chamber wall toward the back-disk, wherein the chamber wall radially supports a first radial-support bearing at a first axial location, and a second radial-support bearing at a second axial location. The chamber wall is part of a bearing housing configured for the chamber wall to off-axially twist with the rotor. This advantageously provides for the twist off axis with the wheel, which limits the possibility of contact between the seal-member and the back-disk, thus allowing for smaller clearances than would otherwise be obtainable.

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

BRIEF DESCRIPTION OF THE DRAWINGS

FIG. 1 is a cross-sectional view of a turbine or compressor wheel mounted to a wall of a bearing housing.

DETAILED DESCRIPTION OF THE PREFERRED EMBODIMENTS

The invention summarized above and defined by the enumerated claims may be better understood by referring to the following detailed description, which should be read with the accompanying drawings. This detailed description of particular preferred embodiments of the invention, set out below to enable one to build and use particular implementations of the invention, is not intended to limit the enumerated claims, but rather, it is intended to provide particular examples of them.

Typical embodiments of the present invention reside in a rotary machine equipped with a rotational pressure-changing wheel (e.g., a compressor wheel or a turbine wheel) having adaptations that limit and/or tune the axial forces produced by that wheel during normal operational conditions (i.e., over a range of operating conditions for which the wheel was designed to operate).

With reference to FIG. 1, in a first embodiment of the invention, a rotary machine is formed from a housing 101 and a rotor 103. The rotor is configured to rotate within the housing along an axis of rotor rotation 105. The rotor includes a rotational pressure-changing wheel 107 (e.g., a compressor wheel or a turbine wheel) configured with a hub 111 and a plurality of blades 113.

The blades 113 are configured to exchange energy between the potential energy of the pressure of a stream 115 of gas passing through the blades and rotor 103 kinetic rotational energy. For example, if the wheel 107 is a compressor wheel, the wheel may be configured to take ambient air and pressurize it using the rotational kinetic energy of the rotor. Similarly, if the wheel is a turbine wheel, the rotor is configured to take pressurized air (such as an exhaust stream) and lower its pressure, converting its potential energy into kinetic energy of the rotor.

The hub 111 includes a blade surface 121 on one axial side of the hub. The blade surface carries and supports the blades 113. The hub further includes a back-disk 123 (surface) on an axially opposite side of the hub from the blade surface. The back-disk faces a chamber wall 125 of a bearing housing, which is a sub-housing of the housing 101. The chamber wall in turn faces the back-disk. Between them, the chamber wall and back-disk define boundaries of a back-disk chamber 127, which is the clearance area between the back-disk and the chamber wall.

The chamber wall 125 forms one or more off-center orifices 131 that open the back-disk chamber 127 into an interior chamber of the bearing housing with an environment having a different pressure from the back-disk chamber during normal operational conditions of the wheel. Typically, this environment is ambient pressure air. Preferably, each orifice is not impeded by moving parts such as bearing parts that can vary the resistance to the flow of gas through the orifice. More preferably, each orifice is a calibrated hole in the chamber wall. The one or more orifices are calibrated for a desired pressure drop between the back-disk chamber and the environment having a different pressure from the back-disk chamber during normal operational conditions. Thus, the effective size of the one or more orifices is selected to limit the pressure change of the back-disk chamber through the one or more orifices during normal operation. The pressure drop may therefore be tuned for a desired pressure level in the back-disk chamber.

The rotary machine further includes a back-disk seal member 141 that extends substantially between the back-disk 123 and the chamber wall 125. The back-disk seal member preferably protrudes axially from the chamber wall and extends circumferentially around the back-disk chamber 127 forming a circularly symmetric protrusion that defines the radial extent (boundary) of the back-disk chamber.

The back-disk seal member is composed of a material significantly softer than the materials of the hub and the chamber wall. If the back-disk seal member comes into contact with the opposing surface (e.g., the back-disk), it will immediately wear away without significantly affecting the performance of the rotary machine. This feature allows for the clearance between the back-disk seal member and the opposing surface to be extremely tight, Preferably, the back-disk seal member is composed of a plastic material that will be rapidly worn away if it comes in contact with an opposing surface (e.g., if it is mounted to the chamber wall and comes into contact with the metal of the hub back-disk, or if it is mounted to the back-disk and comes into contact with the metal of the chamber wall.

The back-disk seal member 141 forms a plurality of separate circular axial sub-protrusions 143. Each separate sub-protrusion extends around the circumference of the rotor and toward the back-disk at a plurality of different radial locations. This feature allows for different amounts of wear on different sub-protrusions while minimizing the total pressure loss across the whole back-disk seal member.

To minimize the clearance between the back-disk seal member and its opposing wall, and to minimize the wearing of the back-disk seal member, the chamber wall radially supports a first radial-support bearing 151 at a first axial location, and a second radial-support bearing 153 at a second axial location. The first and second radial-support bearings radially support the rotor while freely allowing it to rotate. The housing is adapted such that the chamber wall 125 is configured to off-axially flex during off-axis motion of the rotor. As such, the back-disk seal member 141 will deflect with off axis motion of the rotor. This feature will minimize contact between the back-disk seal member and its opposing surface (e.g., the back-disk), while minimizing the clearance distance between the two, While particular forms of the invention have been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the scope of the invention. Accordingly, the invention is not intended to be limited by the above discussion, and is defined with reference to the following claims.

What is claimed is:

1. A turbocharger, comprising:

a bearing housing;

one or more bearing orifices opening into an interior chamber of the bearing housing, each bearing orifice of the one or more bearing orifices being centered along an axis of rotor rotation, and each bearing orifice of the one or more bearing orifices containing one or more bearings of a plurality of bearings; and a rotor extending through the bearing orifices to pass through the interior chamber of the bearing housing, the rotor being radially restrained by the one or more bearings within the bearing orifices to allow rotation of the rotor along the axis of rotor rotation, the rotor including a rotational pressure-changing wheel outside the interior chamber of the bearing housing, the pressure-changing wheel forming a hub and a plurality of blades, the plurality of blades being positioned to exchange the pressure of gas passing through the blades and rotor kinetic rotational energy, and the hub forming a blade surface that carries and supports the blades, and a back-disk on an axially opposite side of the hub from the blade surface;

wherein the bearing housing forms a chamber wall facing the back-disk, the chamber wall and back-disk defining a back-disk chamber, the chamber wall separating the back-disk chamber from the interior chamber of the bearing housing;

wherein the chamber wall forms a first bearing orifice of the one or more bearing orifices, the first bearing orifice extending between the back-disk chamber and the interior chamber of the bearing housing;

wherein the chamber wall forms an off-center vent orifice extending between the back-disk chamber and the interior chamber of the bearing housing to vent pressure differences across the first bearing orifice through a path unobstructed by the plurality of bearings, the off-center vent orifice not being impeded by moving parts, and the off-center vent orifice being offset from the axis of rotation and separate from the first bearing orifice; and wherein the back-disk chamber forms an annular passageway between the gas passing between the blades and the off-center vent orifice.

2. The turbocharger of claim 1, wherein the turbocharger operates over a range of operating pressures, and wherein the effective size of the off-center vent orifice limits a pressure change of the back-disk chamber through the off-center vent orifice with the turbocharger operating over the range of operating pressures.

3. The turbocharger of claim 1, and further comprising:

a back-disk seal member, the back-disk seal member extending substantially between the back-disk and the chamber wall, the back-disk seal member extending circumferentially around the back-disk chamber;

wherein the chamber wall is axially supported around its radial periphery, and wherein the back-disk seal member extends from the chamber wall within the radial periphery in which the chamber wall is axially supported.

4. The turbocharger of claim 3, wherein the back-disk seal member forms a plurality of separate sub-protrusions, each separate sub-protrusion extending around the circumference of the rotor at a plurality of radial locations.

5. The turbocharger of claim 4, wherein the plurality of separate sub-protrusions includes at least three separate sub-protrusions extending around the circumference of the rotor at a plurality of radial locations.

6. The turbocharger of claim 5, wherein the turbocharger operates over a range of operating pressures, and wherein the effective size of the off-center vent orifice limits a pressure change of the back-disk chamber through the off-center vent orifice with the turbocharger operating over the range of operating pressures.

7. The turbocharger of claim 3, wherein the back-disk seal member is affixed to and extends from the chamber wall toward the back-disk, and wherein the chamber wall radially supports a first radial-support bearing of the plurality of bearings at a first axial location in the first bearing orifice, and a second radial-support bearing of the plurality of bearings at a second axial location in the first bearing orifice.

8. The turbocharger of claim 7, wherein the back-disk seal member forms a plurality of separate sub-protrusions, each separate sub-protrusion extending around the circumference of the rotor and toward the back-disk at a plurality of radial locations.

9. The turbocharger of claim 8, wherein the plurality of separate sub-protrusions includes at least three separate sub-protrusions extending around the circumference of the rotor at a plurality of radial locations.

10. The turbocharger of claim 9, wherein the turbocharger operates over a range of operating pressures, and wherein the effective size of the off-center vent orifice limits a pressure change of the back-disk chamber through the off-center vent orifice with the turbocharger operating over the range of operating pressures.

11. A turbocharger, comprising:

a bearing housing forming a chamber wall defining a boundary of an interior chamber within the bearing housing, wherein the chamber wall forms a bearing orifice extending through the chamber wall into the interior chamber;

a rotor radially extending through the bearing orifice, and being restrained within the bearing housing along an axis of axial rotor rotation, the rotor including a rotational pressure-changing wheel outside the bearing housing, the pressure-changing wheel forming a hub and a plurality of blades, the plurality of blades being positioned to exchange the pressure of gas passing through the blades and rotor kinetic rotational energy, the hub including a blade surface that carries and supports the blades, and the hub further including a back-disk on an axially opposite side of the hub from the blade surface, wherein the bearing housing chamber wall faces the back-disk, the chamber wall and back-disk defining a back-disk chamber, the chamber wall separating the back-disk chamber from the interior chamber; and a back-disk seal member, the back-disk seal member extending from the chamber wall toward the back-disk between the back-disk and the chamber wall, the back-disk seal member extending circumferentially around the back-disk chamber;

wherein the chamber wall is axially supported around its radial periphery, and wherein the back-disk seal member extends from the chamber wall within the radial periphery in which the chamber wall is axially supported;

wherein the chamber wall forms a first flange around the bearing orifice, the first flange axially extending the bearing orifice; and wherein the chamber wall radially supports the rotor with a first radial-support bearing at a first axial location, and with a second radial-support bearing at a second axial location, the first axial location being within the first flange.

12. The turbocharger of claim 11, wherein the back-disk seal member is affixed to and seated in a circumferential groove in the chamber wall.

13. The turbocharger of claim 11, wherein the back-disk seal member forms a plurality of separate sub-protrusions, each separate sub-protrusion extending around the circumference of the rotor at a plurality of radial locations.

14. The turbocharger of claim 13, wherein the plurality of separate sub-protrusions includes at least three separate sub-protrusions extending around the circumference of the rotor at a plurality of radial locations.

15. The turbocharger of claim 11, wherein the back-disk seal member is composed of a material softer than the material of the hub.

16. The turbocharger of claim 15, wherein the back-disk seal member forms a plurality of separate sub-protrusions, each separate sub-protrusion extending around the circumference of the rotor at a plurality of radial locations.

17. The turbocharger of claim 16, wherein the plurality of separate sub-protrusions includes at least three separate sub-protrusions extending around the circumference of the rotor at a plurality of radial locations.

18. The turbocharger of claim 11, wherein the first flange axially extends the bearing orifice toward the internal chamber.

19. The turbocharger of claim 18, wherein the chamber wall forms a second flange around the bearing orifice, wherein the second flange axially extends the bearing orifice away from the internal chamber, and wherein the second axial location is within the second flange.

20. The turbocharger of claim 11, wherein:

the chamber wall forms a second flange around the bearing orifice, the second flange axially extending the bearing orifice away from the first flange;

the second axial location is within the second flange; and the chamber wall radially supports the rotor with a third radial-support bearing at a third axial location, the third axial location being within the first flange.

* * * * *